US009163831B2

(12) United States Patent
Chen

(10) Patent No.: US 9,163,831 B2
(45) Date of Patent: Oct. 20, 2015

(54) FLAME DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 384 days.

(21) Appl. No.: 13/721,147

(22) Filed: Dec. 20, 2012

(65) Prior Publication Data

US 2013/0252188 A1 Sep. 26, 2013

(30) Foreign Application Priority Data

Mar. 22, 2012 (TW) ..... 101109923 A

(51) Int. Cl.
*F23D 14/06* (2006.01)
*F23D 14/84* (2006.01)
*F23D 14/10* (2006.01)

(52) U.S. Cl.
CPC ..... *F23D 14/10* (2013.01); *F23D 14/06* (2013.01); *F23D 14/84* (2013.01); *F23D 2206/0094* (2013.01)

(58) Field of Classification Search
CPC ..... F23D 14/06; F23G 7/065
USPC ..... 431/9, 8, 169, 182, 185
See application file for complete search history.

(56) References Cited

U.S. PATENT DOCUMENTS 850,996 A * 4/1907 Cooley ..... 431/355
3,463,602 A * 8/1969 Bitterlich et al. ..... 431/188
3,493,180 A * 2/1970 Walsh ..... 239/406
3,733,169 A * 5/1973 Lefebvre ..... 431/265
4,708,638 A * 11/1987 Brazier et al. ..... 431/116
4,884,555 A * 12/1989 Huang ..... 122/17.1
5,236,350 A * 8/1993 Cummings et al. ..... 431/173
5,538,340 A * 7/1996 Brashears ..... 366/25
6,155,821 A * 12/2000 Hellum ..... 431/354
6,238,206 B1 * 5/2001 Cummings et al. ..... 431/181
6,652,268 B1 * 11/2003 Irwin et al. ..... 431/284
7,097,448 B2 8/2006 Chesney
D621,873 S 8/2010 Tsai
2005/0016178 A1 * 1/2005 Wasif et al. ..... 60/752
2009/0226852 A1 * 9/2009 Feese et al. ..... 431/9
2010/0154779 A1 * 6/2010 Andors et al. ..... 126/512
2010/0330514 A1 * 12/2010 Lam ..... 431/12

FOREIGN PATENT DOCUMENTS

CN 2881382 Y 3/2007
CN TW201022600 A 6/2010

* cited by examiner

*Primary Examiner* — Steven B McAllister
*Assistant Examiner* — Rabeeul Zuberi
(74) *Attorney, Agent, or Firm* — Alan D. Kamrath; Kamrath IP Lawfirm, P.A.

(57) ABSTRACT

A flame device includes a fluid inducing assembly that can induce external air therein. A flow diverting mechanism includes a plurality of vanes. The plurality of vanes is circumferentially disposed, and each pair of adjacent vanes includes a space therebetween defining a passage which is spiral shaped. Each vane has a first section exposed to outside and not concealed by a concealing member defining a flow intake zone. Each vane has a second section encircled by the concealing member defining a flow accelerating zone. A shield is disposed above the fluid inducing assembly. A combustion head is disposed above the flow diverting mechanism and includes a mixing chamber, a flame guiding member, and a plurality of grooves. The flame guiding member is in a spaced relationship and circumferentially conceals a wall delimiting the mixing chamber.

20 Claims, 10 Drawing Sheets

FLAME DEVICE

BACKGROUND OF THE INVENTION

1. Field of the Invention

The present invention relates to a flame device and, particularly, to a flame device producing a stable and elongated swirling flame.

2. Description of the Related Art

U.S. Pat. No. 7,097,448 discloses a vortex type gas lamp for producing an upwardly directed vortex flame inside a surrounding and confined boundary of a rotating body of air. An interface is located between the body of air which is devoid of gas and a central region of gas which is bounded by the interface during the operation of the gas lamp. All of the combustion of gas substantially occurs inside the interface. The gas lamp has a central axis and includes a base supplying combustible gas without air at and nearly adjacent to the central axis. The gas lamp further includes a shield including first and second axially extending sections structurally attached to the base in a fluid sealing relationship. The first and second sections are substantially identical and transparent to light, and each includes an impermeable wall having an arcuate inner surface and an arcuate outer surface. Furthermore, each of the first and second sections has first and second edges extended axially. The gas lamp yet further includes the first and second walls alternately overlapping one another. The first and second walls are adjacent to their edges and are spaced from one another to form tangentially directed ports, thereby forming an axially extending mixing chamber open at its side only through the ports. Furthermore, the first and second sections are arranged so that at the base they surround the entry of the combustible gas and so that the gas receives air for combustion only through the ports. Thus, combustion of the gas results in a flame spaced from the inner surfaces, and the peripheral body of air is devoid of gas entering through the ports. Generally, if no air is supplied for combustion, a flame will extinguish. Unfortunately, it is not easy to prevent excess air from entering the chamber through the ports and to create a stable swirling flame during combustion, since the ports are directly open to air. If the device is placed under an environment with wind, a height and swirling pattern of the flame can be greatly disturbed by excess air flow through the ports caused by wind. Additionally, the base of the chamber is also heated during combustion, but there is not enough air flow through the base to provide cooling and to cause the top surface of the base to be very hot and not safe to touch.

Furthermore, U.S. Design Pat. No. 621,873 discloses a fire tornado lamp including a base and a shield. The base includes a plurality of ports disposed circumferentially. The shield is transparent to light, is hollow and includes a passage extended therein. The base and the shield are connected to each other. Each port extends radially with respect to and is in communication with the passage defined in the shield. Each port is so configured that it induces air into the passage in a direction substantially tangential to a circumference of the passage. Likewise, it is not easy to preclude excess air from entering through the ports, and the flame is susceptible to wind. Also, the guided air flow provided for combustion and cooling can only enter the chamber through the ports above the bottom of the burning flame at an angle perpendicular to the flame direction. This configuration can generate a swift swirling flame and can induce strong convection during combustion. However, it is difficult to control the swirling speed and pattern of the flame, and the base of the device can be very hot.

The present invention is, therefore, intended to obviate or at least alleviate the problems encountered in the prior art.

SUMMARY OF THE INVENTION

According to the present invention, a flame device includes a fluid inducing assembly including a support and a flow diverting mechanism mounted on the support. The flow diverting mechanism includes a plurality of vanes. The plurality of vanes is circumferentially disposed. Each pair of adjacent vanes includes a space therebetween defining a passage which is spiral shaped. The support includes a concealing member mounted thereon and which has an enclosed circumferential edge. Each vane has a first section exposed to outside and not concealed by the concealing member defining a flow intake zone. Each vane has a second section encircled by the concealing member defining a flow accelerating zone. The support and the flow diverting mechanism include an air intake port disposed therebetween. External air flows into the flow diverting mechanism through the air intake port. A shield is hollow, is transparent to light, and is disposed above the fluid inducing assembly. Further, a combustion head is disposed above the flow diverting mechanism and includes a mixing chamber, a flame guiding member, and a plurality of grooves. The flame guiding member has a first end and a second end opposite to the first end. One of the first and second ends is open, and the other of the first and second ends is enclosed. The flame guiding member is in a spaced relationship and circumferentially conceals a wall delimiting the mixing chamber. The plurality of grooves fluidly communicates the mixing chamber and a space between the flame guiding member and the wall delimiting the mixing chamber.

Gas and air flowing into the flame device are directed to undergo a first mixing process in the mixing chamber, and a gas and air mixture flows out of the mixing chamber to the space defined between the mixing chamber and the flame guiding member through the plurality of grooves and is mixed with air flowing in the space defined between the mixing chamber to undergo a second mixing process.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objects, advantages, and new features of the present invention will become apparent from the following detailed description of the invention when considered in conjunction with the accompanied drawings.

DETAILED DESCRIPTION OF THE INVENTION

Figure 1:
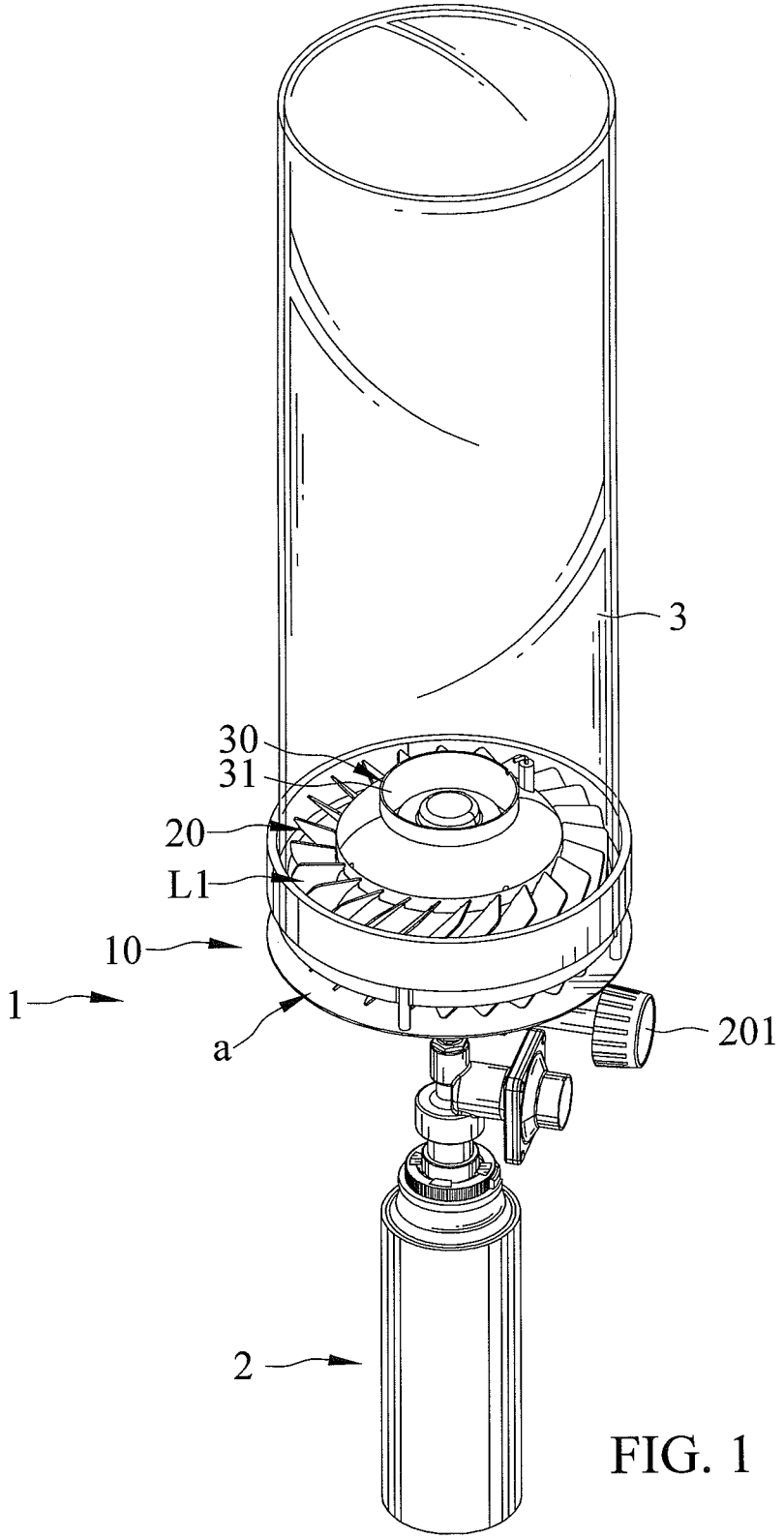
FIG. 1 is a perspective view showing a flame device in accordance with the present invention.
Figure 2:
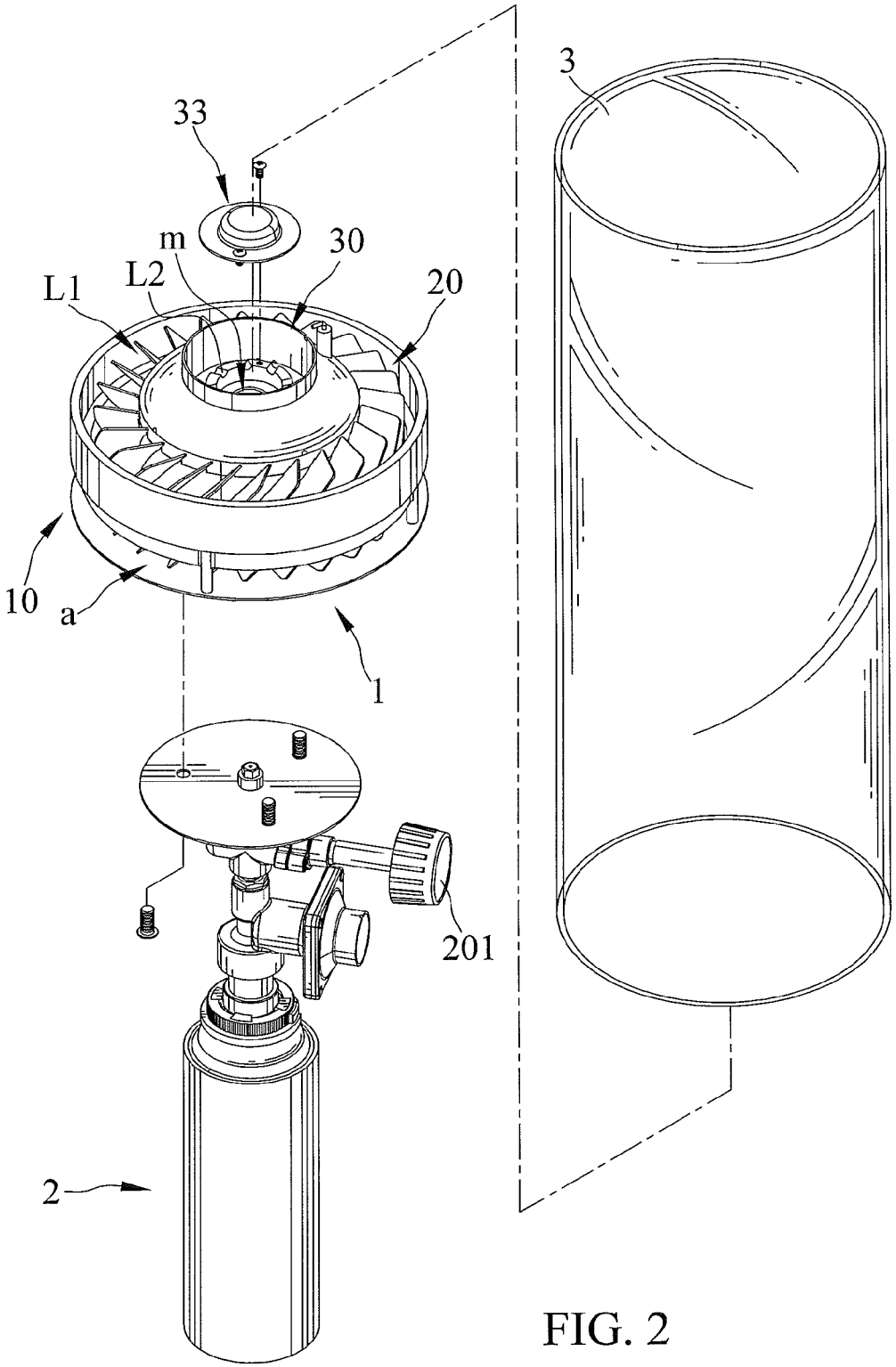
FIG. 2 is an exploded perspective view of the flame device shown in FIG. 1.
Figure 3:
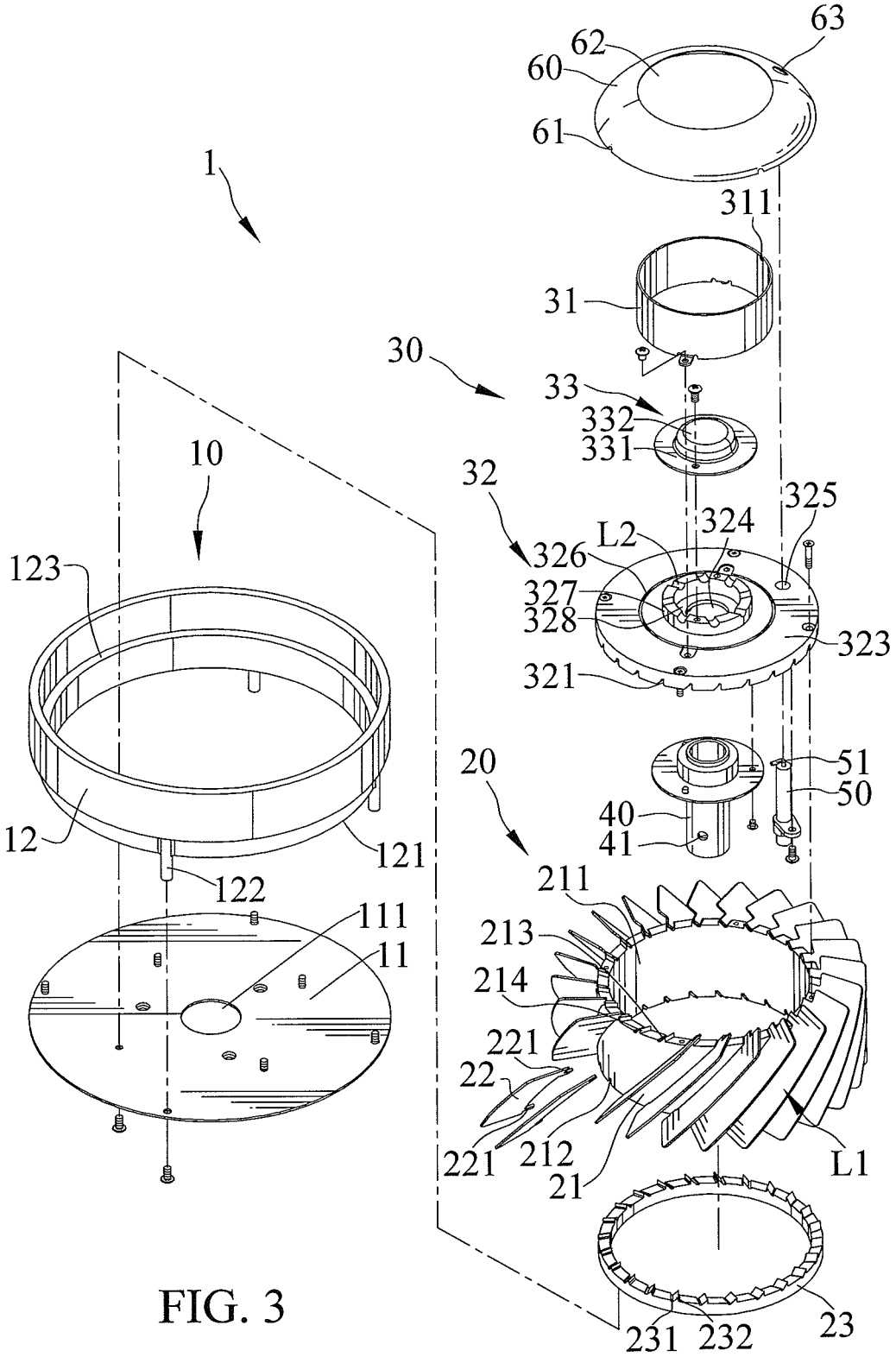
FIG. 3 is a further exploded perspective view of the flame device shown in FIG. 1.
Figure 4:
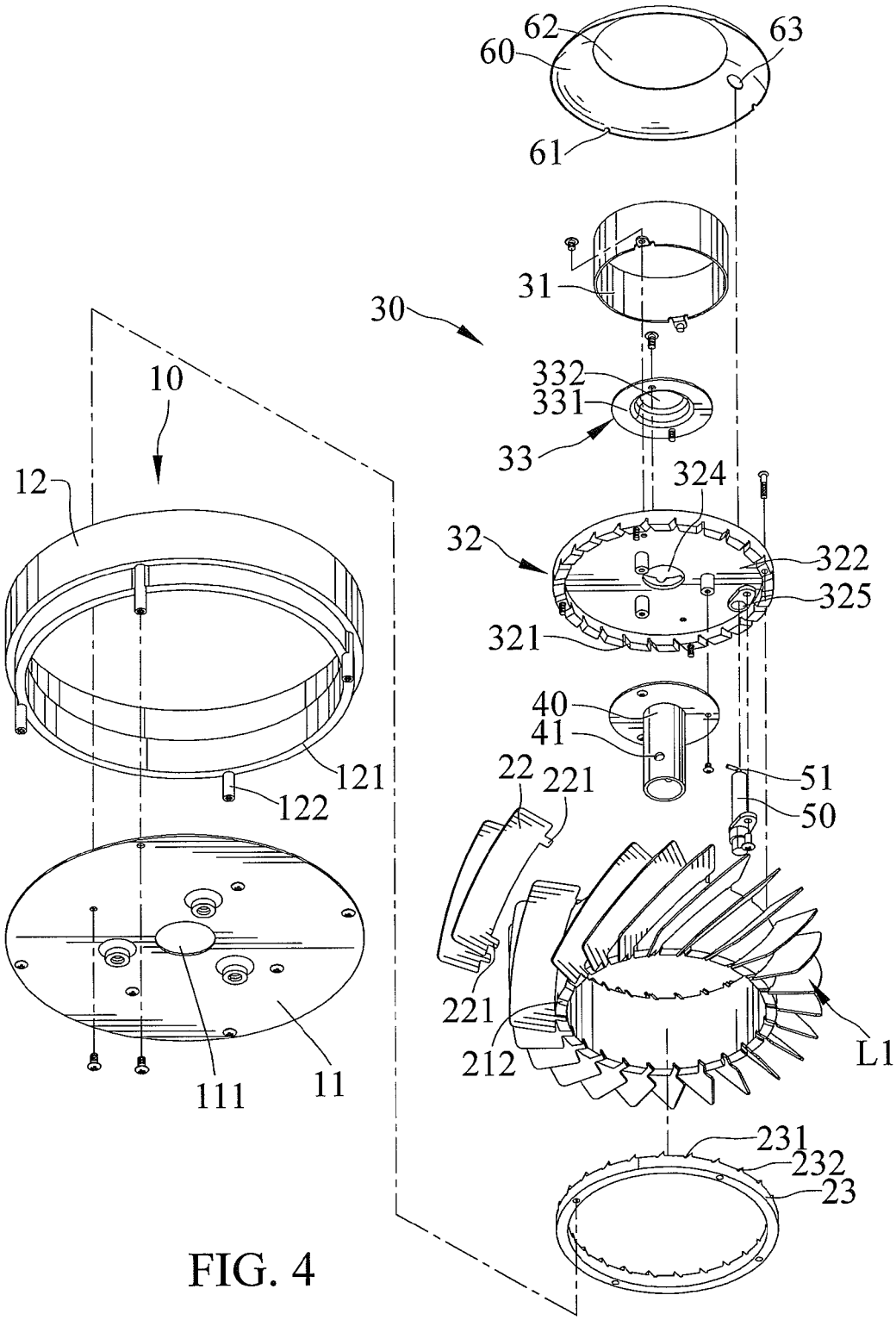
FIG. 4 is another further exploded perspective view of the flame device shown in FIG. 1, but taken from a different angle of view than FIG. 3.
Figure 5:
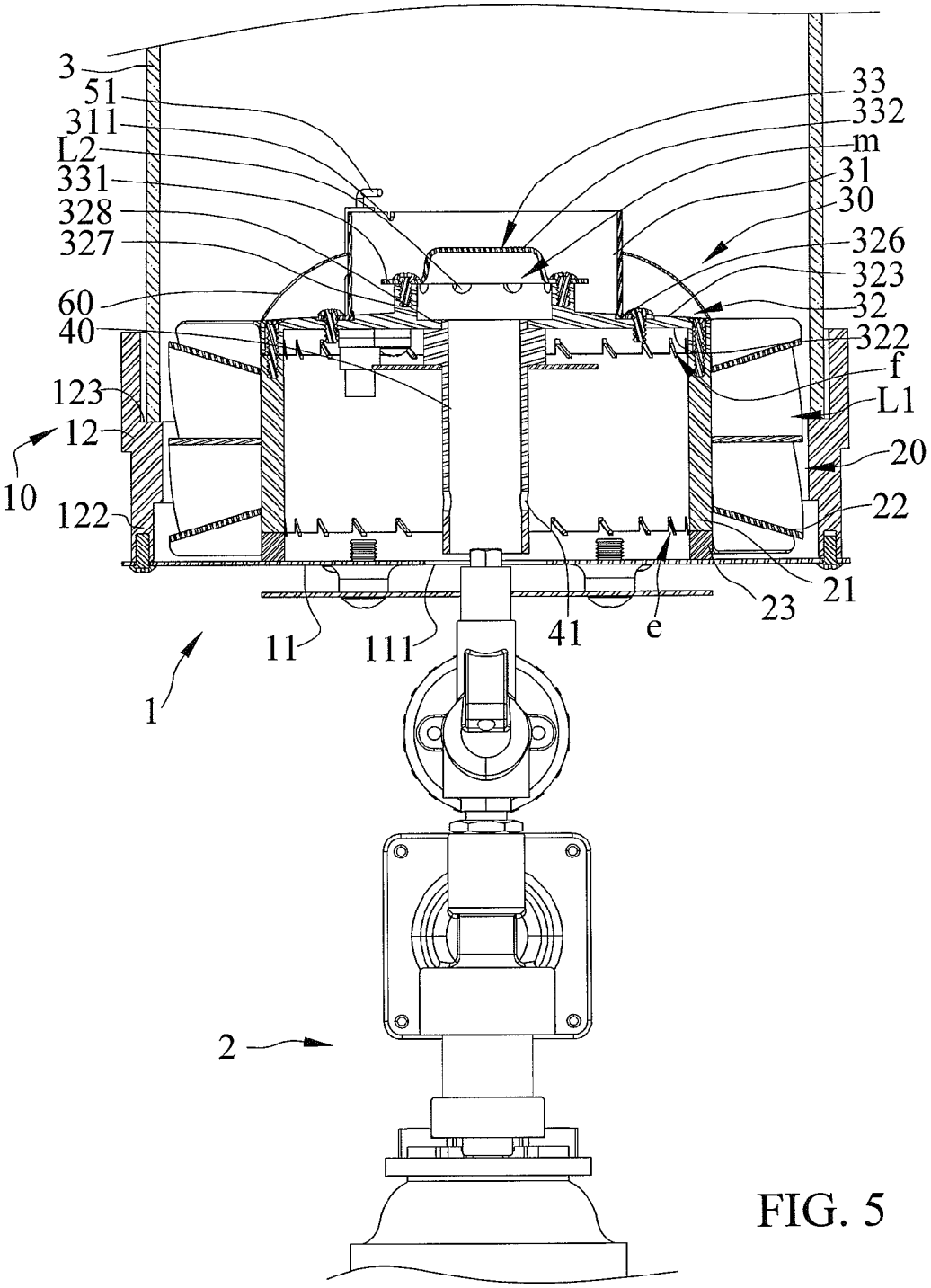
FIG. 5 is a partial cross-sectional view of FIG. 1.
Figure 6:
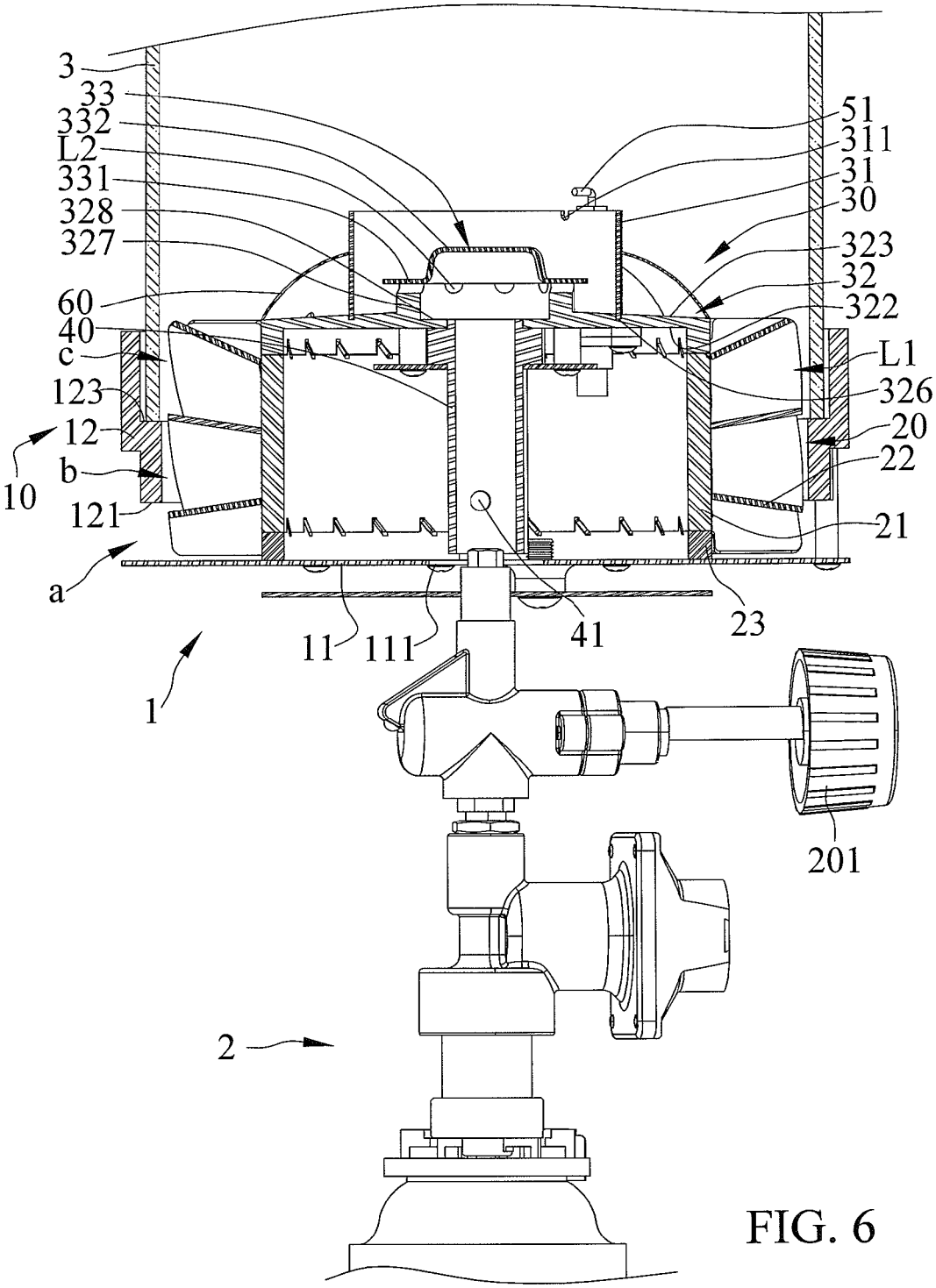
FIG. 6 is another partial cross-sectional view of FIG. 1.
Figure 7:
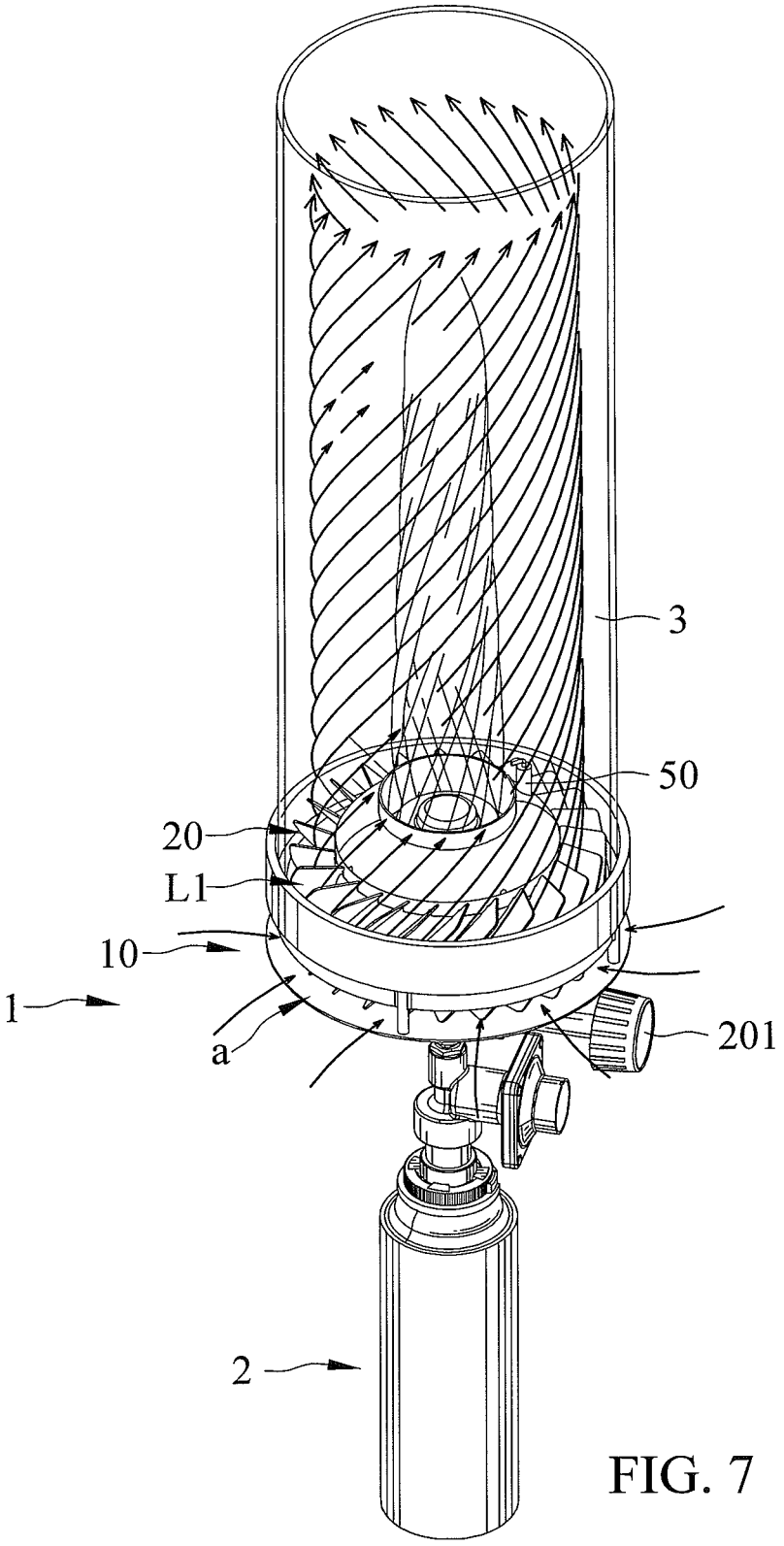
FIG. 7 is a perspective view showing the flame device producing a stable and prolonged flame in a stable fluid field, with the arrows showing the fluid field.
Figure 8:
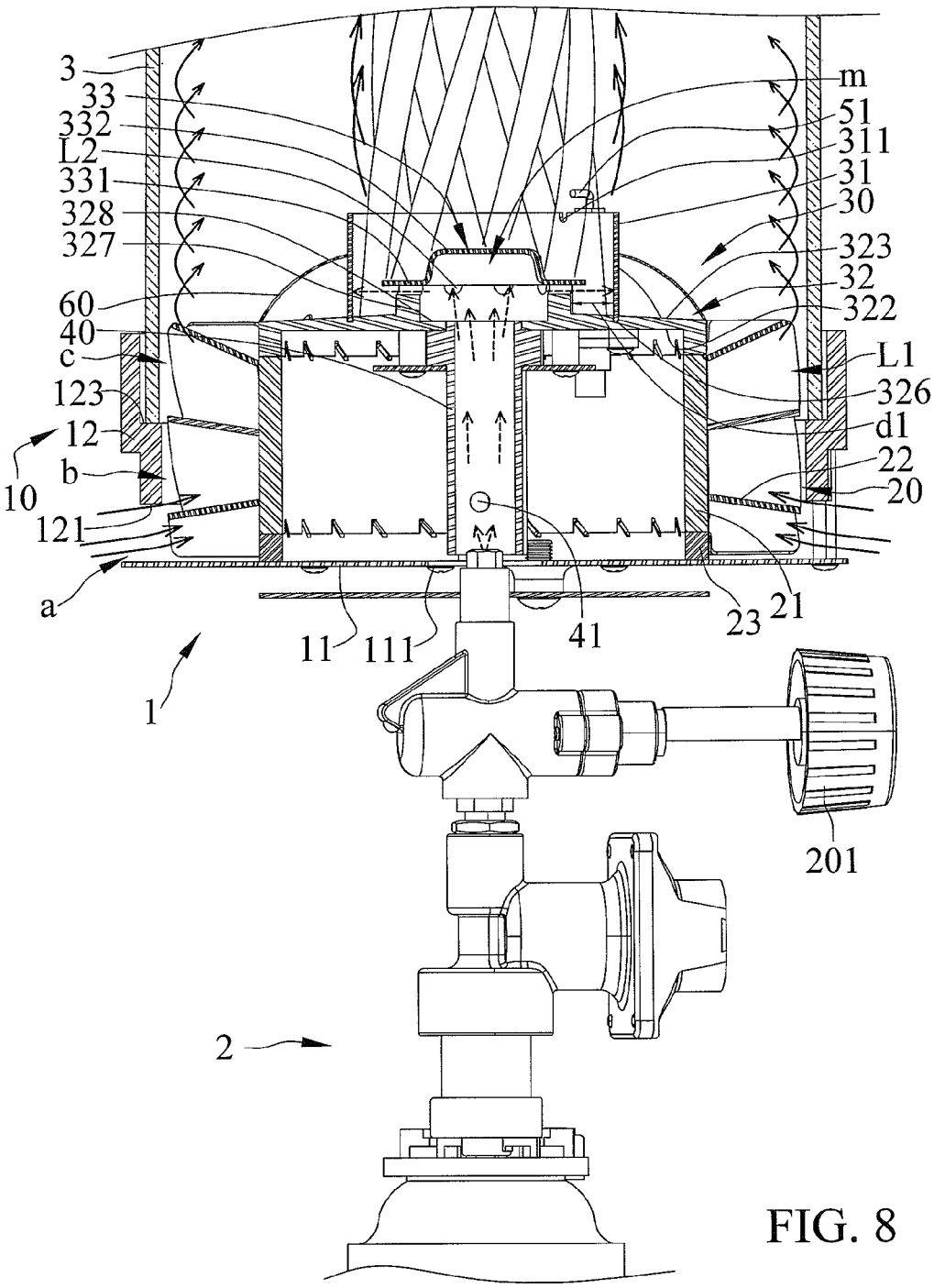
FIG. 8 is a partial cross-sectional view of FIG. 7.
Figure 9:
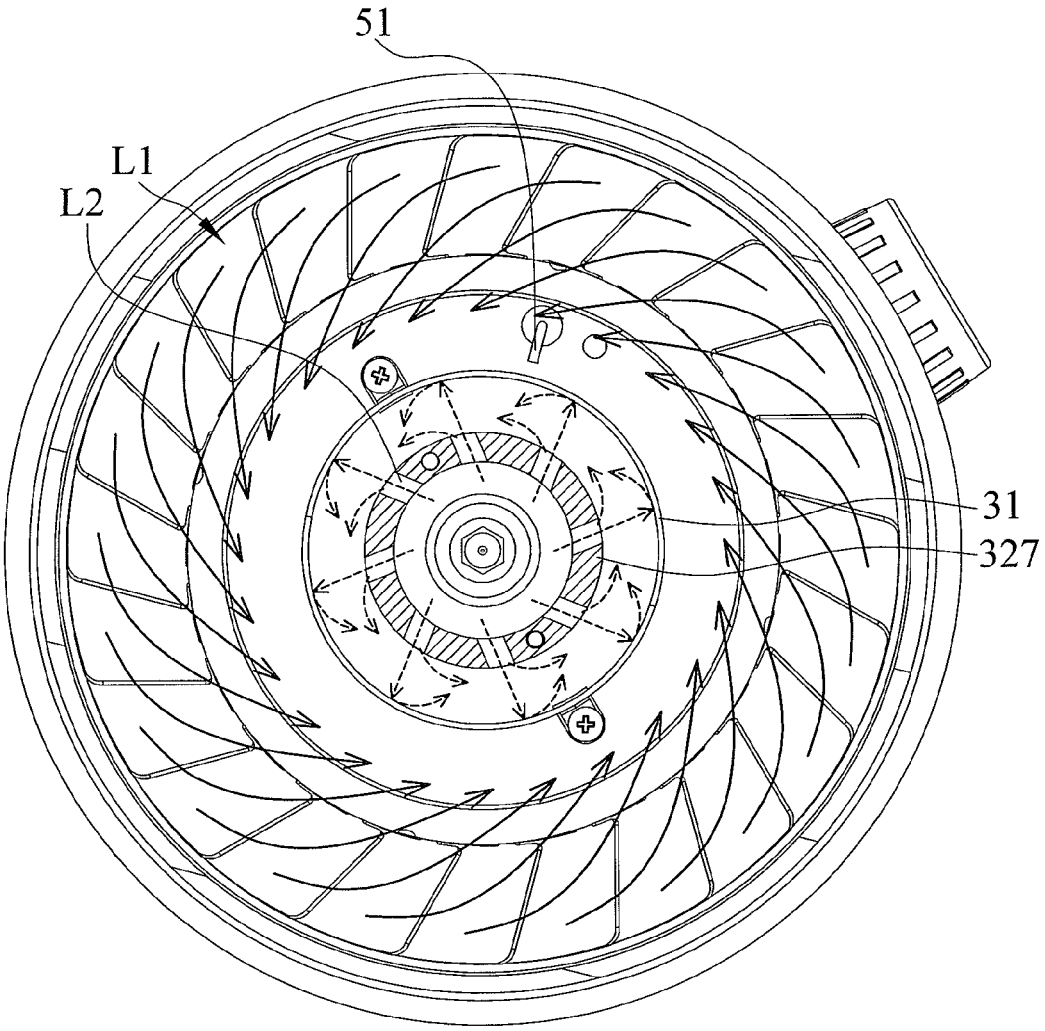
FIG. 9 is a top view of the FIG. 7.
Figure 10:
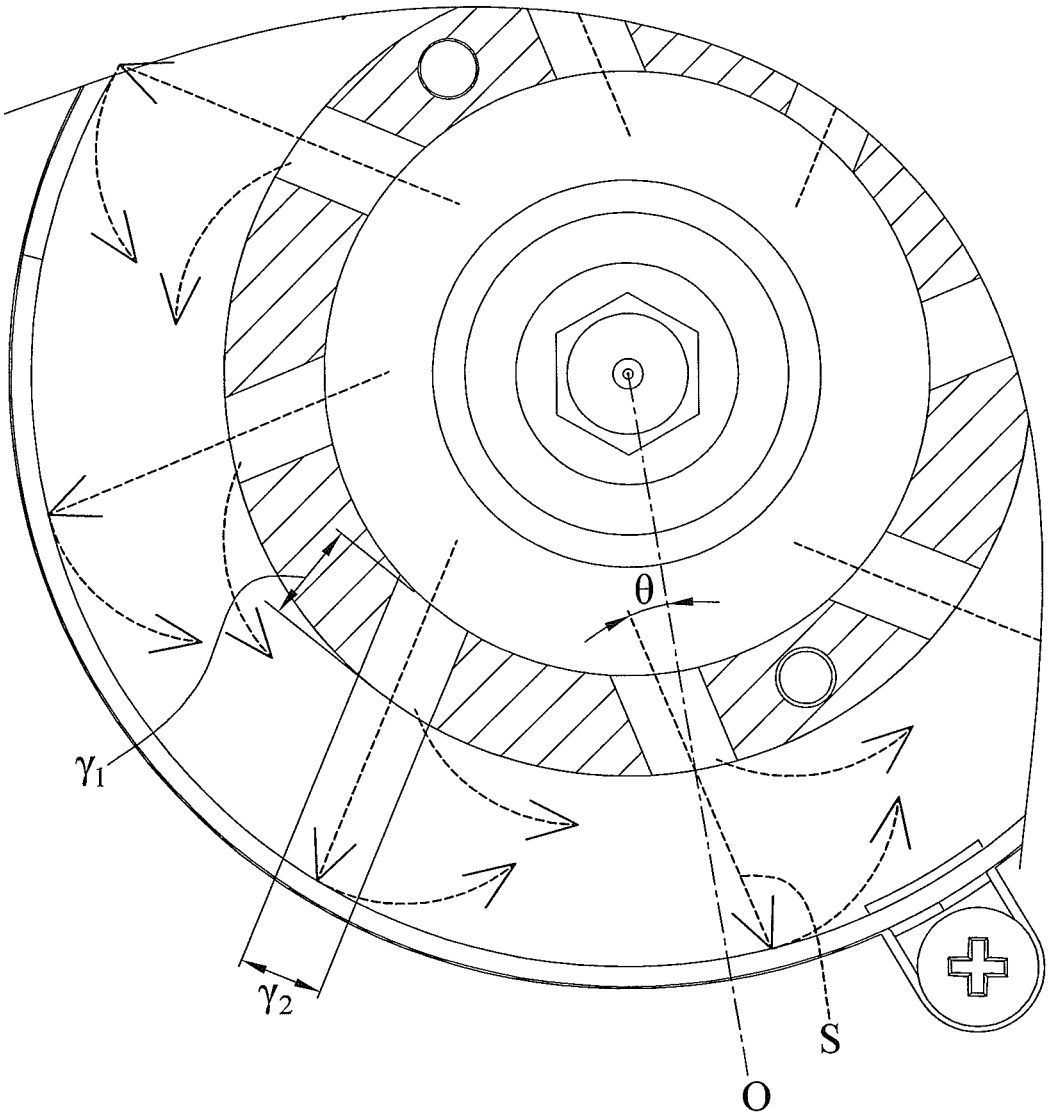
FIG. 10 is an enlarged view of FIG. 9.

FIGS. 1 through 10 show a flame device for producing a stable and elongated swirling flame in accordance with the present invention. The device includes a fluid inducing assembly 1, a fuel supply device 2, and a shield 3.

The fluid inducing assembly 1 includes a support 10 and a flow diverting mechanism 20 mounted on the support 10. The support 10 includes a concealing member 12 mounted thereon. The support 10 includes a base 11. The concealing member 12 is mounted on the base 11. The base 11 includes a center thereof having a through hole 111 extended therethrough. The fuel supply device 2 is engaged with the base 11 and includes a head portion engaged in the through hole 111. The concealing member 12 has an enclosed circumferential edge. The support 10 and the flow diverting mechanism 20 include an air intake port a disposed therebetween. External air flows into the flow diverting mechanism 20 through the air intake port a. The base 11 and the concealing member 12 have at least one gap formed therebetween defining the air intake port a. The concealing member 12 is of an annular shape. The concealing member 12 includes an end 121 thereof spaced from the base 11 at a distance and having a plurality of fixing feet 122 extended therefrom. Each fixing foot 122 has an end fixed to the base 11. The at least one gap that defines the air intake port a is formed between the end 121 of the concealing member 12 and the base 11.

The flow diverting mechanism 20 also includes a tube 21 and a first engaging member 23. The tube 21 has an enclosed periphery. The plurality of vanes 22 is mounted on the tube 21. The flow diverting mechanism 20 includes a plurality of vanes 22. The plurality of vanes 22 is circumferentially disposed. Each pair of adjacent vanes 22 includes a space therebetween defining a passage L1 which is spiral shaped. Each vane 22 has a first section exposed to outside and not concealed by the concealing member 12 defining a flow intake zone b. Each vane 22 has a second section encircled by the concealing member 12 defining a flow accelerating zone c. The tube 21 includes a first end thereof having a first joining end and a second end thereof having a second joining end. The first engaging member 23 has an end thereof forming a third joining end fixed to the first joining end, and a plurality of first gaps e is formed between the first and third joining ends. The second engaging member 32 has an end thereof forming a fourth joining end fixed to the second joining end, and a plurality of second gaps f is formed between the second and fourth joining ends. Each vane 22 includes two attaching ends 221 extending in the same direction. One attaching end is insertably engaged in one of the plurality of first gaps e to fix to the tube 21 and the first engaging member 23, and the other attaching end 221 is insertably engaged in one of the plurality of second gaps f to fix to the tube 21 and the second engaging member 32, respectively.

The first joining end forms a plurality of recesses 212. The plurality of recesses 212 is disposed circumferentially. The third joining end forms a plurality of recesses 231 and a plurality of protrusions 232. The plurality of recesses 231 is disposed circumferentially. The plurality of protrusions 232 is disposed circumferentially. The plurality of recesses 212 is radially extended with respect to different reference points rather than a center of the tube 21. The plurality of recesses 231 is radially extended with respect to different reference points rather than a center of first engaging member 23. The plurality of protrusions 232 is radially extended with respect to different reference points rather than the center of first engaging member 23. One recess 231 and one protrusion 232 are together received in one of the plurality of recesses 212.

The second joining end forms a plurality of recesses 213 and a plurality of protrusions 214. The plurality of recesses 213 is disposed circumferentially. The plurality of protrusions 214 is disposed circumferentially. The fourth joining end forms a plurality recesses 321 disposed circumferentially. The plurality of recesses 213 is radially extended with respect to different reference points rather than a center of the tube 21. The plurality of protrusions 214 is radially extended with respect to different reference points rather than the center of the tube 21. The plurality of recesses 321 is radially extended with respect to different reference points rather than a center of second engaging member 32. One recess 213 and one protrusion 214 are together received in one of the plurality of recesses 321.

A combustion head 30 is disposed above the flow diverting mechanism 20 and includes a mixing chamber m, a flame guiding member 31, a second engaging member 32, and a plurality of grooves L2. The flame guiding member 31 has a first end and a second end opposite to the first end. One of the first and second ends is open, and the other of the first and second ends is enclosed. The flame guiding member 31 is in a spaced relationship and circumferentially conceals a wall delimiting the mixing chamber m. The plurality of grooves L2 fluidly communicates the mixing chamber m and a space between the flame guiding member 31 and the wall delimiting the mixing chamber m. The combustion head 30 includes the second engaging member 32 having a bottom side 322 and a top side 323. The top side 323 includes the plurality of grooves L2 inset thereon. A first imaginary axis O is adapted to be radially drawn from a center of the combustion head 30. A second imaginary axis S is adapted to be drawn radially along a longitudinal direction of one of the plurality of grooves L2. One first and one second imaginary axes O and S are adapted to be intersected at an angle θ in one groove L2. The angle θ is in a range of 10-30 degrees. Each of the plurality of grooves L2 is U shaped. The second engaging member 32 includes a center thereof having a hole 324 extended through the bottom side 322 and the top side 323 thereof. A conduit 40 is inserted through the hole 324. The combustion head 30 includes the top side 323 thereof including an annular channel 326 inset. Each of the plurality of grooves L2 is with a length r1 and a width r2. The ratio of the length r1 to the width r2 is in a range of 1 to 3 for stable guiding the gas and air mixture. The flame guiding member 31 includes a first end thereof engaged in the annular channel 326. The exit of groove L2 to the flame guiding member 31 is with a distance dl. The ratio of the distance dl to the groove length r1 is in the range of 1-3. The top side 323 includes a protruded edge 327 extended therefrom, and the protruded edge 327 includes an end thereof including the plurality of grooves L2 inset thereon. The flame guiding member 31 circumferentially conceals the protruded edge 327. The combustion head 30 includes a lid 33 having a fixing edge 331 and a projection 332 protruded from the fixing edge 331. The fixing edge 331 is mounted on the end of the protruded edge 327, and each of the plurality of grooves L2 has a top end capped by the fixing edge 331. The projection 332 includes a cavity formed therein and fluidly communicating with the mixing chamber m and the plurality of grooves L2. The flame guiding member 31 circumferentially conceals the lid 33. The second engaging member 32 includes a wall that delimits the hole 324 including a ridge 328 extended therefrom. The conduit 40 has an end abutted against the ridge 328.

In the embodiment, the fuel supply device 2 also includes an ignition switch 201.

The shield 3 is hollow and transparent to light and is disposed above the fluid inducing assembly 1. An internal diameter of the flame guiding member 31 and an internal diameter of the shield 3 have a ratio in a range of 0.2-0.8 to provide an adequate inlet air flow adjustment. The shield 3 is supported on the concealing member 12. The concealing member 12 has an inner periphery thereof including a ridge 123 protruded therefrom and the shield 3 has an end thereof supported by the ridge 123. The shield 3 also has a periphery thereof including a portion abutted against the inner periphery of the concealing member 12. The shield 3 is securely supported by the concealing member 12.

The conduit 40 is surrounded within the flow diverting mechanism 20. The conduit 40 is disposed at a center of the support 10. The tube 21 is hollow and has an inner periphery 211 thereof including a conduit 40 disposed therein. The conduit 40 has a periphery including at least one orifice 41 extended therethrough. Gas from the fuel supply device 2 flows to the mixing chamber m through the conduit 40, and the least one orifice 41 allows air in the flame device to flow into the conduit 40. Two orifices 41 are extended through the periphery of the conduit 40. The two orifices 41 are disposed on two lateral sides of the conduit 40, respectively. The two orifices 41 are diametrically opposed.

An igniting head 50 includes an end thereof having an igniting needle 51. The second engaging member 32 includes a first aperture 325 extended therethrough and including the igniting head 50 mounted therein. The igniting head 50 includes the igniting needle 51 disposed outside the first aperture 325. The flame guiding member 31 includes a lateral side thereof having an ignition point 311 disposed adjacent to and pointed at the igniting needle 51. In the process of ignition, the igniting needle 51 produces sparks at the ignition point 311.

The flame guiding member 31 is insertably engaged with a cap 60. The cap 60 includes a peripheral edge thereof having at least one drainage hole 61 to prevent liquid from dripping onto the second engaging member 32. The cap 60 is in the form of a ring. The cap 60 has a bore 62 extended therethrough. The flame guiding member 31 is insertably engaged in the bore 62. The cap 60 also has an aperture 63 extended therethrough and disposed corresponding to the first aperture 325 on the second engaging member 32. The igniting head 50 includes the igniting needle 51 disposed outside the aperture 63 on the cap 60.

Gas and air flowing into the flame device are directed to undergo a first mixing process in the mixing chamber m, and the gas and air mixture flows out of the mixing chamber m to the space defined between the mixing chamber m and the flame guiding member 31 through the plurality of grooves L2 and is mixed with air flowing in the space defined between the mixing chamber m to undergo a second mixing process.

In view of the foregoing, if the flame guiding member 31 is absent, it is difficult to control gas and air in the flame device to undergo the second mixing process. The flame guiding member 31 has one of the first and second ends open and the other of the first and second ends enclosed. The flame guiding member 31 allows controlling convection between the secondary gas mixing and fresh air drawn from outside the chamber. Without the flame guiding member 31, flame that burns on the mixing gas from the first mixing process undergoes convection directly with air in the transparent shield 3, thereby creating larger portion of colorless and transparent flame, causing a less visible swirling pattern and shorter flame height. Moreover, gas and air in the flame device undergo the first mixing process in the mixing chamber m, and the lid 33 enclosing a top open end of the mixing chamber m includes the cavity formed in the projection 332 thereof making the gas and air mixture susceptible to backflow circulation therein. The lid 33 therefore facilitates a thorough mixing of gas and air mixture in the mixing chamber m. After the gas and air mixture has thoroughly mixed in the mixing chamber m and the pressure difference is stabled, a gas and air mixture flows out of the mixing chamber m to the space defined between the outside of the mixing chamber m and the flame guiding member 31 through the plurality of grooves L2, and is mixed with air flowing in the space defined between the outside of the mixing chamber m to undergo the second mixing process.

After the gas and air mixture in the flame device has undergone the second mixing process and is being ignited by the igniting needle 51 of the igniting head 50, a combustion flame flowing out from the plurality of grooves L2 and fresh air drawn from the plurality of passages L1 mix together. Moreover, the flame heats the air in the shield 3 and creates buoyancy due to a difference in air density. Air in the shield 3 driven by buoyancy goes upward and draws in fresh air through the plurality of passages L1. The plurality of passages L1 makes air flowing therein rotate and go upward. Air drawn in the plurality of passages L1 of the flame device is also subjected to centrifugal forces that keeps it moving spirally and such forces drive air as it is drawn into the shield 3 of the flame device. Fresh air drawn into the flame device through the plurality of passages L1 is accelerated and drives the flame in the flame device to rotate and stretch up higher, thereby increasing height of the flame in the flame device. The swirling speed and the shape of flame in the flame device are determined by the height of protruded edge 327 and the angle θ.

The second engaging member 32 and the base 11 are disposed oppositely on the flow diverting mechanism 20, so the base 11 stay away from the flame in the flame device. The base 11 is disposed adjacent to the air intake port a, and air flowing into the air intake port a will pass through the base 11 to go into the flow intake zone b of the plurality of passages L1, thereby cooling the base 11. A user who touches or carries the flame device on the base 11 will not get singed.

The flame device has a concentrated hot zone around and above the combustion head due to the combustion flame and spiral flow around. Heated air with a lower density in the hot zone flows upward and creates a low pressure to draw fresh air from intake port into the transparent shield 3, thereby increasing height of the flame in the flame device. This phenomenon is also known as a stack effect. Additionally, the plurality of passages L1 directs fresh air toward the inner surface of transparent shield 3 at a specific angle to create a spiral air flow pattern tangent to the inner surface of transparent shield 3. This feature can greatly help to stabilize a swirling air flow pattern inside the transparent shield 3 due to the Coanda effect and the centrifugal force effect. The Coanda effect states that a fluid or gas stream will attach a contour when flow is directed at a tangent to that surface. The centrifugal force effect is due to spiral motion of air flow. The flame device fully takes advantages of the stack effect and the Coanda effect which help create a stable spiral and elongated flame. The combination of the mentioned effects can substantially elongate the height of the flame and change the swirling speed of the flame according to the different flame visualization effect required.

The flame device can produce a swirling flame, and since the gas and air mixture undergo the first and second mixing processes and since air flows out the plurality of passages L1 spirally and a stable fluid field is created in the shield 3, the spiral frame is obvious and has a stable shape and an elongated height.

While the specific embodiments have been illustrated and described, numerous modifications come to mind without significantly departing from the spirit of invention and the scope of invention is only limited by the scope of the accompanying claims.

What is claimed is:

1. A flame device comprising:

a fluid inducing assembly including a support and a flow diverting mechanism mounted on the support, with the flow diverting mechanism including a plurality of vanes, with the plurality of vanes circumferentially disposed, with each pair of adjacent vanes including a space therebetween defining a passage which is spiral shaped, with the support including a base and a concealing member mounted thereon, with the concealing member having an annular shape, with the plurality of vanes supported above the base and located within the concealing member, with at least one gap axially formed between the base and the concealing member, with each vane having a first axial section exposed to outside via the at least one gap and not concealed by the concealing member defining a flow intake zone in communication with the at least one gap, with each vane having a second axial section encircled by the concealing member defining a flow accelerating zone, with the first axial section being axially intermediate the base and the the second axial section, with external air flowing into the flow diverting mechanism through the air intake port;

a shield being annular, hollow, transparent to light, and disposed above the fluid inducing assembly, with the shield mounted to and axially extending from the concealing member; and a combustion head disposed above the flow diverting mechanism and including a mixing chamber, a flame guiding member, and a plurality of grooves, with the flame guiding member being annular and having a first end and a second end opposite to the first end with one of the first and second ends open and with another of the first and second ends enclosed, with the flame guiding member disposed in a spaced relationship and circumferentially concealing a wall delimiting the mixing chamber, with the flame guiding member located concentrically within the plurality of vanes and the shield, with the mixing chamber located concentrically within the flame guiding member, with the plurality of grooves fluidly communicating with the mixing chamber and a space between the flame guiding member and the wall delimiting the mixing chamber;

wherein gas and air are directed to undergo a first mixing process in the mixing chamber and a gas and air mixture flows out of the mixing chamber to the space defined between the mixing chamber and the flame guiding member through the plurality of grooves and is mixed with air flowing in the space defined between the mixing chamber and the wall delimiting the mixing chamber to undergo a second mixing process.

2. The flame device as claimed in claim 1 further comprising a conduit surrounded within the flow diverting mechanism, wherein the conduit has a periphery including at least one orifice extended therethrough, and wherein the gas from a fuel supply device flows to the mixing chamber through the conduit and the least one orifice allows the air to flow into the conduit.

3. A flame device comprising:

a fluid inducing assembly including a support and a flow diverting mechanism mounted on the support, with the flow diverting mechanism including a plurality of vanes, with the plurality of vanes circumferentially disposed, with each pair of adjacent vanes including a space therebetween defining a passage which is spiral shaped, with the support including a concealing member mounted thereon and having an enclosed circumferential edge, with each vane having a first section exposed to outside and not concealed by the concealing member defining a flow intake zone, with each vane having a second section encircled by the concealing member defining a flow accelerating zone, with the support and the flow diverting mechanism including an air intake port disposed therebetween, with external air flowing into the flow diverting mechanism through the air intake port;

a shield being hollow and transparent to light and disposed above the fluid inducing assembly;

a combustion head disposed above the flow diverting mechanism and including a mixing chamber, a flame guiding member, and a plurality of grooves, with the flame guiding member having a first end and a second end opposite to the first end with one of the first and second ends open and another of the first and second ends enclosed, with the flame guiding member disposed in a spaced relationship and circumferentially concealing a wall delimiting the mixing chamber, with the plurality of grooves fluidly communicating the mixing chamber and a space between the flame guiding member and the wall delimiting the mixing chamber, wherein the combustion head includes an engaging member having a bottom side and a top side, and wherein the top side includes the plurality of grooves inset thereon; and a conduit surrounded within the flow diverting mechanism, wherein the conduit has a periphery including at least one orifice extended therethrough, and wherein the gas from a fuel supply device flows to the mixing chamber through the conduit and the least one orifice allows the air to flow into the conduit;

wherein gas and air are directed to undergo a first mixing process in the mixing chamber and a gas and air mixture flows out of the mixing chamber to the space defined between the mixing chamber and the flame guiding member through the plurality of grooves and is mixed with air flowing in the space defined between the mixing chamber to undergo a second mixing process.

4. The flame device as claimed in claim 3, wherein the flow diverting mechanism includes a tube and another engaging member, wherein the tube is hollow and has an inner periphery thereof receiving the conduit, wherein the plurality of vanes is mounted on the tube, wherein the tube includes a first end thereof having a first joining end and a second end thereof having a second joining end respectively, wherein the other engaging member has an end thereof forming a third joining end fixed to the first joining end, wherein a plurality of first gaps is formed between the first and third joining ends, wherein the engaging member has an end thereof forming a fourth joining end fixed to the second joining end, wherein a plurality of second gaps is formed between the second and fourth joining ends, and wherein each vane includes two attaching ends extending in the same direction with one attaching end insertably engaged in one of the plurality of first gaps to fix to the tube and the other engaging member and with another attaching end insertably engaged in one of the plurality of second gaps to fix to the tube and the engaging member, respectively.

5. The flame device as claimed in claim 1, wherein a first imaginary axis is adapted to be radially drawn from a center of the combustion head, wherein a second imaginary axis is adapted to be drawn radially along a longitudinal direction of one of the plurality of grooves, wherein the first and second imaginary axes intersect at an angle in one groove, and wherein the angle is in a range of 10-30 degrees.

6. The flame device as claimed in claim 3, wherein the combustion head includes the top side thereof including an annular channel inset, wherein each of the plurality of grooves has a length and a width, wherein the ratio of the length to the width is in a range of 1-3 for stable guiding the gas and air mixture, wherein the flame guiding member includes a first end thereof engaged in the annular channel and a second end thereof at a height from the top side of the combustion head, wherein an exit of each of the plurality of grooves to the flame guiding member is with a distance, and wherein the ratio of the distance to the length is in the range of 1-3.

7. The flame device as claimed in claim 3, wherein the top side includes a protruded edge extended therefrom, wherein the protruded edge includes an end thereof including the plurality of grooves inset thereon, wherein the flame guiding member circumferentially conceals the protruded edge, wherein the combustion head includes a lid having a fixing edge and a projection protruded from the fixing edge, wherein the fixing edge is mounted on the end of the protruded edge, wherein each of the plurality of grooves has a top end capped by the fixing edge, wherein the projection includes a cavity formed therein and fluidly communicating with the mixing chamber and the plurality of grooves, and wherein the flame guiding member circumferentially conceals the lid.

8. The flame device as claimed in claim 3 further comprising an igniting head including an end thereof having an igniting needle, wherein the engaging member includes a first aperture extended therethrough and including the igniting head mounted therein, wherein the igniting head includes the igniting needle disposed outside the aperture, and wherein the flame guiding member includes a lateral side thereof having an ignition point disposed adjacent to and pointed at the igniting needle.

9. The flame device as claimed in claim 3, wherein the flame guiding member is insertably engaged with a cap, and wherein the cap includes a peripheral edge thereof having at least one drainage hole to prevent liquid from dripping onto the engaging member.

10. The flame device as claimed in claim 1, wherein an internal diameter of the flame guiding member and an internal diameter of the shield have a ratio in a range of 0.2-0.8 to provide an adequate flow rate.

11. The flame device as claimed in claim 6, wherein the top side includes a protruded edge extended therefrom, wherein the protruded edge includes an end thereof including the plurality of grooves inset thereon, wherein the flame guiding member circumferentially conceals the protruded edge, wherein the combustion head includes a lid having a fixing edge and a projection protruded from the fixing edge, wherein the fixing edge is mounted on the end of the protruded edge, wherein each of the plurality of grooves has a top end capped by the fixing edge, wherein the projection includes a cavity formed therein and fluidly communicating with the mixing chamber and the plurality of grooves, and wherein the flame guiding member circumferentially conceals the lid.

12. The flame device as claimed in claim 11 further comprising an igniting head including an end thereof having an igniting needle, wherein the engaging member includes a first aperture extended therethrough and including the igniting head mounted therein, wherein the igniting head includes the igniting needle disposed outside the aperture, and wherein the flame guiding member includes a lateral side thereof having an ignition point disposed adjacent to and pointed at the igniting needle.

13. The flame device as claimed in claim 12, wherein the flame guiding member is insertably engaged with a cap, and wherein the cap includes a peripheral edge thereof having at least one drainage hole to prevent liquid from dripping onto the engaging member.

14. The flame device as claimed in claim 13, wherein an internal diameter of the flame guiding member and an internal diameter of the shield have a ratio in a range of 0.2-0.8 to provide an adequate flow rate.

15. The flame device as claimed in claim 14, wherein a first imaginary axis is adapted to be radially drawn from a center of the combustion head, wherein a second imaginary axis is adapted to be drawn radially along a longitudinal direction of one of the plurality of grooves, wherein the first and second imaginary axes intersect at an angle in one groove, and wherein the angle is in a range of 10-30 degrees.

16. The flame device as claimed in claim 15, wherein the flow diverting mechanism includes a tube and another engaging member, wherein the tube is hollow and has an inner periphery thereof receiving the conduit, wherein the plurality of vanes is mounted on the tube, wherein the tube includes a first end thereof having a first joining end and a second end thereof having a second joining end respectively, wherein the other engaging member has an end thereof forming a third joining end fixed to the first joining end, wherein a plurality of first gaps is formed between the first and third joining ends, wherein the engaging member has an end thereof forming a fourth joining end fixed to the second joining end, wherein a plurality of second gaps is formed between the second and fourth joining ends, and wherein each vane includes two attaching ends extending in the same direction with one attaching end insertably engaged in one of the plurality of first gaps to fix to the tube and the other engaging member and with another attaching end insertably engaged in one of the plurality of second gaps to fix to the tube and the engaging member, respectively.

17. The flame device as claimed in claim 8, wherein the flame guiding member is insertably engaged with a cap, and wherein the cap includes a peripheral edge thereof having at least one drainage hole to prevent liquid from dripping onto the second engaging member.

18. The flame device as claimed in claim 17, wherein a first imaginary axis is adapted to be radially drawn from a center of the combustion head, wherein a second imaginary axis is adapted to be drawn radially along a longitudinal direction of one of the plurality of grooves, wherein the first and second imaginary axes intersect at an angle in one groove, and wherein the angle is in a range of 10-30 degrees.

19. The flame device as claimed in claim 18, wherein the combustion head includes the top side thereof including an annular channel inset, wherein each of the plurality of grooves has a length and a width, wherein the ratio of the length to the width is in a range of 1-3 for stable guiding the gas and air mixture, wherein the flame guiding member includes a first end thereof engaged in the annular channel and a second end thereof at a height from the top side of the combustion head, wherein an exit of each of the plurality of grooves to the flame guiding member is with a distance, and wherein the ratio of the distance to the length is in the range of 1-3.

20. The flame device as claimed in claim 19, wherein an internal diameter of the flame guiding member and an internal diameter of the shield have a ratio in a range of 0.2-0.8 to provide an adequate flow rate.

* * * * *